US007086372B2

(12) United States Patent
Takiguchi et al.

(10) Patent No.: US 7,086,372 B2
(45) Date of Patent: Aug. 8, 2006

(54) CONNECTION STRUCTURE BETWEEN A PLASTIC GEAR AND A SUPPORT SHAFT, OIL PUMP INCLUDING THE CONNECTION STRUCTURE, AND ENGINE INCORPORATING SAME

(75) Inventors: Chikashi Takiguchi, Saitama (JP); Akira Takahashi, Saitama (JP); Teruo Kihara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 173 days.

(21) Appl. No.: 10/903,592

(22) Filed: Jul. 30, 2004

(65) Prior Publication Data

US 2005/0058553 A1 Mar. 17, 2005

(30) Foreign Application Priority Data

Sep. 17, 2003 (JP) ..... 2003-324655

(51) Int. Cl.
*F01M 1/00* (2006.01)

(52) U.S. Cl. ..... 123/196 R

(58) Field of Classification Search ..... 123/196 R; 417/310

See application file for complete search history.

(56) References Cited

U.S. PATENT DOCUMENTS 2,916,031 A * 12/1959 Parsons ..... 477/99

FOREIGN PATENT DOCUMENTS

JP 3-38470 8/1991

* cited by examiner

*Primary Examiner*—Tony M. Argenbright
*Assistant Examiner*—Katrina B. Harris
(74) *Attorney, Agent, or Firm*—Carrier, Blackman & Associates, P.C.; William D. Blackman; Joseph P. Carrier

(57) ABSTRACT

A connection structure between a plastic gear and a shaft permits easy phase matching relative to a device mounted on the shaft, and easy meshing of a gear provided on the shaft with another gear. The connection structure includes a plastic gear, a shaft, and a set plate. The plastic gear has a geometric recess which receives the correspondingly-shaped set plate therein. The set plate includes a central shaped opening. The shaft is provided with a mating extension extending from a first end, and which fits within the shaped opening. The mating extension is formed such that the plastic gear may be mounted thereon in a first position wherein the plastic gear is not positioned to interact with a mating gear, and the plastic gear can be slidably moved thereon to a second position such that the plastic gear is positioned to interact with the mating gear.

19 Claims, 4 Drawing Sheets

CONNECTION STRUCTURE BETWEEN A PLASTIC GEAR AND A SUPPORT SHAFT, OIL PUMP INCLUDING THE CONNECTION STRUCTURE, AND ENGINE INCORPORATING SAME

CROSS-REFERENCE TO RELATED APPLICATIONS

The present invention claims priority under 35 USC 119 based on Japanese patent application No. 2003-324655, filed on Sep. 13, 2003.

BACKGROUND OF THE INVENTION

1. Field of the Invention

The present invention relates to a connection structure between a plastic gear and an oil pump drive shaft for an internal combustion engine.

2. Background Art

A known method for connecting an oil pump shaft to a gear that transmits a driving force thereto includes the steps of providing a U-shaped groove across a center hole in the gear; fitting a lock pin into a through hole provided perpendicularly relative to a centerline of the shaft; and pushing the shaft into the center hole in the gear, thereby fitting the lock pin into the groove in the gear (see, for example, Japanese Utility Model Publication No. Hei 3-38470, FIGS. 1 and 2).

Since, in this known connecting method, the lock pin is mounted in the through hole of the shaft, provided perpendicularly relative to the centerline of the shaft, an axial position of the shaft is fixed relative to an axial position of the gear. This makes it difficult, due to the lock pin coming off position, to perform phase matching of an oil pump rotor when the gear is not in mesh with a mating gear.

What is needed is an improved connecting structure for connecting a gear to an oil pump drive shaft of an internal combustion engine, which permits easy phase matching relative to a device mounted on the shaft, and easy meshing of a gear, provided on the shaft, with another gear. Preferably, such a connecting structure would non-rotatably fix the position of the gear in relation to the shaft, so that the gear and shaft rotate concurrently together as an integral unit.

SUMMARY OF THE INVENTION

It is an object of the present invention to provide an improved connection structure for connecting a plastic driven gear and a shaft. The connection structure hereof is suitable for a plastic oil pump gear, and permits easy phase matching relative to a device mounted on the shaft, and easy meshing of a gear, provided on the shaft, with another gear.

To achieve the aforementioned object, a connection structure between a plastic gear and a shaft, as presented in a first embodiment of the present invention, connects a plastic gear that meshes with a drive gear or a driven gear to a shaft that rotates integrally with the plastic gear.

The connection structure according to a first embodiment hereof includes a mortised opeining provided at a central portion of a rectangular set plate. A rectangular recess, in which the set plate fits, is provided on a front surface of a portion of the plastic gear, to which the shaft is connected, and the set plate is mounted thereon. The shaft has an end portion including a tenon, which is configured and dimensioned to fit through the mortised opening provided in the set plate. The tenon has a length such that, when the plastic gear is connected to the shaft, the tenon of the shaft is first aligned with and then inserted in the mortised opening of the set plate. When the mounting of the tenon in the mortise has proceeded a predetermined amount, the plastic gear is meshed with the mating gear.

The connection structure between a plastic gear and a shaft according to the present invention permits transmission of a driving force through a large area of contact produced between the set plate and the recess. This enhances durability of the plastic gear. The connection structure also allows the plastic gear and the mating gear to be meshed with each other after phase matching of an oil pump rotor is performed with the plastic gear mounted on the shaft but not yet in mesh with the mating gear. This enhances efficiency in phase matching and assembly work.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

It should be understood that only structures considered necessary for explaining and clarifying the present invention are described herein. Other conventional structures, and those of ancillary and auxiliary components of the system, are assumed to be known and understood by those skilled in the art.

Figure 1:
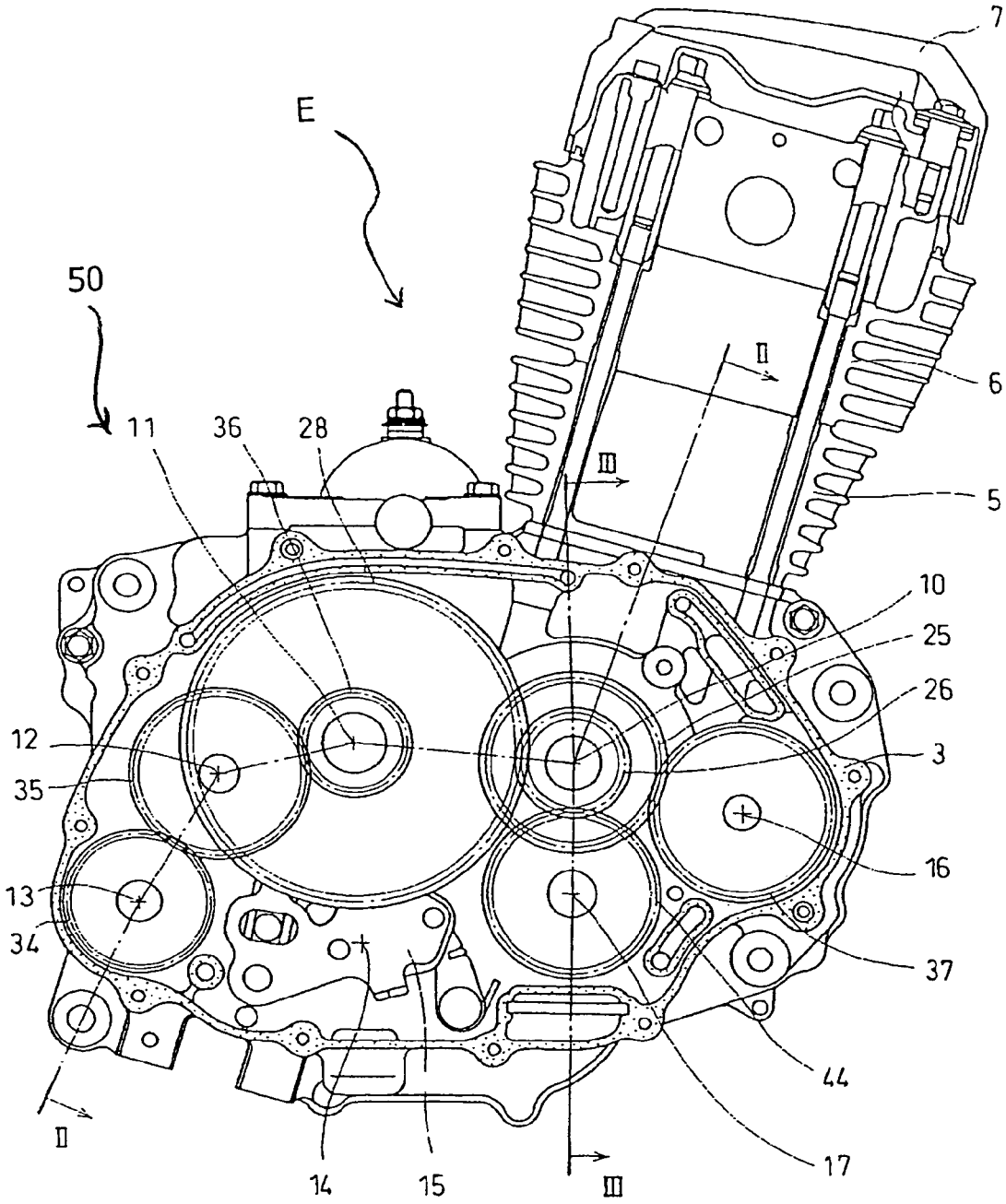
FIG. 1 is a longitudinal cross sectional view of an air-cooled internal combustion engine for a motorcycle according to an illustrative embodiment of the present invention, as viewed from a right-hand side that shows, by removing a right case cover of a transmission, positions of a rotating shaft that protrudes to a right-hand side of a right crankcase and a number of different gears.
Figure 2:
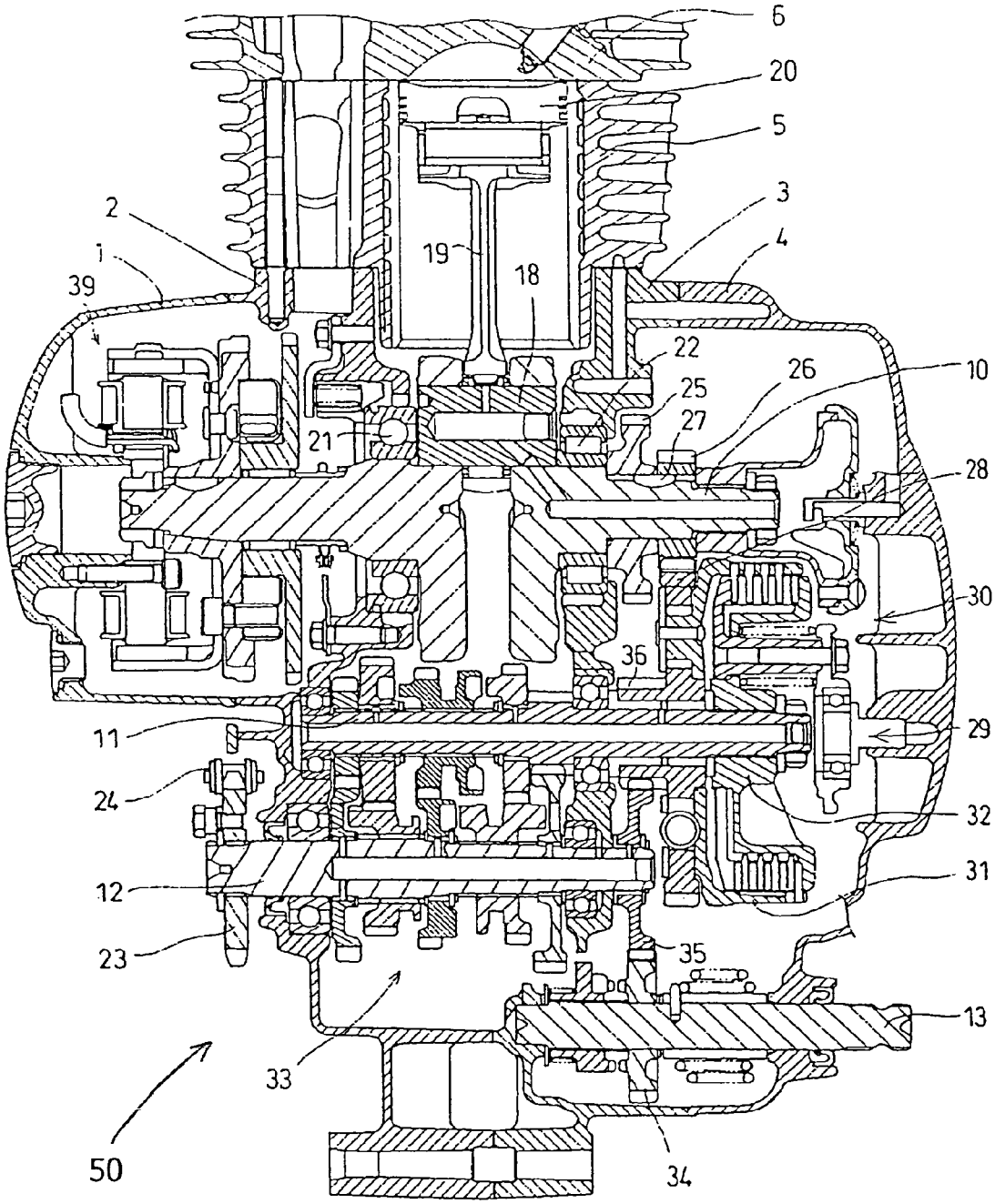
FIG. 2 is a cross sectional view of the engine of FIG. 1, taken along line II—II therein.

Referring to FIGS. 1 and 2, a crankcase assembly 50 for an air-cooled internal combustion engine E is illustrated in cross-section, and is provided for installation on a motorcycle (not shown). The crankcase assembly 50 includes a left case cover 1, a left crankcase 2, a right crankcase 3, and a right case cover 4. A cylinder block 5, a cylinder head 6, and a cylinder head cover 7 are connected, in sequence, to an upper portion of the crankcase assembly 50.

The crankcase assembly 50 includes a crankshaft 10, a main transmission shaft 11, a transmission countershaft 12, and a kick starter shaft 13. The reference numeral 14 represents the position of a center of rotation of a shift drum within the crankcase assembly 50. The crankcase assembly 50 further includes a transmission shifter 15, a balance shaft 16, an oil pump shaft 17, a crankpin 18 and a connecting rod 19 connected to the crankpin 18. A piston 20 is connected to the connecting rod 19, and moves reciprocally up and down in the cylinder block 5.

Referring to FIG. 2, the crankshaft 10 is rotatably supported between the left crankcase 2 and the right crankcase 3 through a ball bearing 21 and a roller bearing 22, respectively. The main transmission shaft 11 and the transmission countershaft 12 are also each respectively supported between the left crankcase 2 and the right crankcase 3 through respective ball bearings. The kick starter shaft 13 is supported by the right crankcase 3 and the right case cover 4. The transmission countershaft 12 is an output shaft of this internal combustion engine.

A drive sprocket 23 is provided on a portion of the transmission countershaft 12 protruding outwardly from the left crankcase 2, as shown. The drive sprocket 23 thus drives a rear wheel of the motorcycle through a chain 24. An alternator 39 is provided on a left end portion of the crankshaft 10.

A balancer drive gear 25 and a shared drive gear 26 are secured, via a key 27, to a right-hand portion of the crankshaft 10. The balancer drive gear 25 meshes with a balancer driven gear 37 (FIG. 1). The shared drive gear 26 meshes with a main shaft driven gear 28 on the main transmission shaft 11 and an oil pump gear 44 on the oil pump shaft 17 (FIG. 1).

The main shaft driven gear 28 is fitted to a right-side portion of the main transmission shaft 11. The main shaft driven gear 28 is in constant mesh with the shared drive gear 26, and is circumferentially rotatable relative to the main transmission shaft 11. A multiple disc clutch 30 is provided on a right end of the main transmission shaft 11. The multiple disc clutch 30 is normally engaged, but disengaged when an operating mechanism 29 is operated. A clutch outer section 31 of the multiple disc clutch 30 is secured to the main shaft driven gear 28. A clutch inner section 32 is secured to the main transmission shaft 11. Rotation of the crankshaft 10 is transmitted to the main shaft driven gear 28 through the shared drive gear 26, and to the main transmission shaft 11 through the multiple disc clutch 30.

Referring to FIG. 2, transmission gears 33 are provided for the main transmission shaft 11 and the countershaft 12. The transmission gears 33 include five gears provided on the main transmission shaft 11 and another five gears provided on the countershaft 12 and in constant mesh with the five gears on the main transmission shaft 11. A total of ten of these gears are classified into any of the following three categories: (a) those secured to the shaft; (b) those held in position by the shaft through a plain bearing that are circumferentially rotatable relative to the shaft, but not movable axially; and (c) those held in position by the shaft through a spline that are axially movable, but not circumferentially rotatable relative to the shaft.

The axially movable gears classified in category (c) make up a dog-tooth clutch. An axially movable gear is moved axially by a shift fork (not shown) that is in constant engagement therewith. The axially movable gear is thereby engaged with a circumferentially rotatable gear classified into category (b), thus locking the gear in category (b) relative to the shaft. Through the operations described above, one pair of gears capable of transmitting drive is selectively made to enable gearshift from a 1st speed up to a 5th speed.

A gear 34 on the kick starter shaft 13 can start to rotate the crankshaft 10 through a gear 35 on a right end portion of the countershaft 12, a gear 36 on a right end portion of the main transmission shaft 11, the main shaft driven gear 28, and the shared drive gear 26 on the crankshaft 10.

Figure 3:
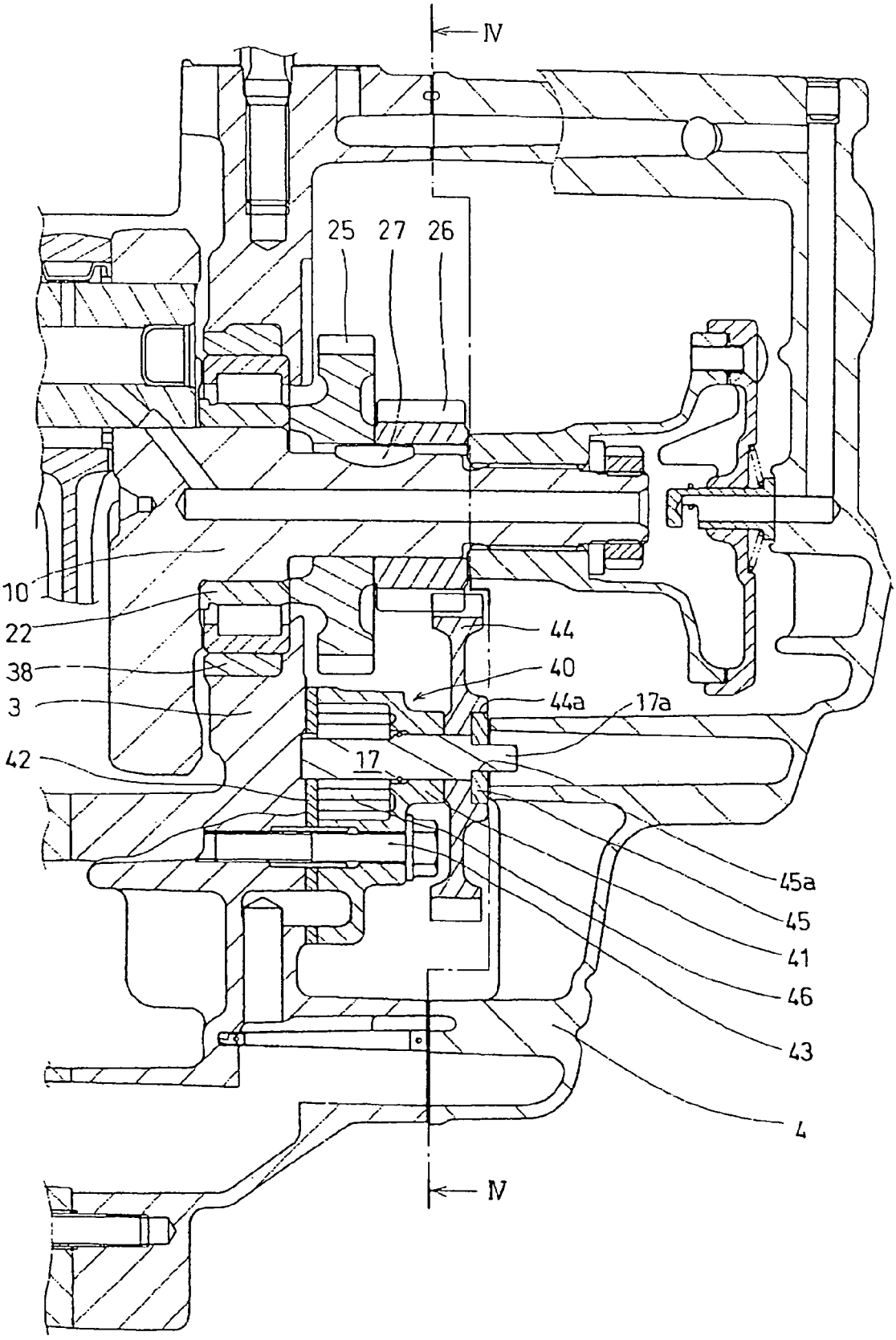
FIG. 3 is a cross sectional detail view of part of the engine of FIG. 1, taken along line III—III thereof, and showing a right-hand half portion inside a crankcase.

FIG. 3 is a cross sectional view taken along line III—III of FIG. 1, showing a right-hand half portion inside the crankcase. The right-hand half portion of the crankshaft 10 is supported on the right crankcase 3 through the roller bearing 22. A bushing 38 is interposed between the right crankcase 3 and the roller bearing 22. As described earlier, the balancer drive gear 25 and the shared drive gear 26 are mounted through the shared key 27 to the crankshaft 10.

As seen best in FIG. 3, an oil pump 40 is provided in the crankcase assembly 50 below the crankshaft 10. A pump case 41 is mounted on the right crankcase 3 through a steel plate 42, being secured thereto with a bolt 43. An oil pump shaft 17 is rotatably supported between the right crankcase 3 and a wall body of the pump case 41.

One end of the oil pump shaft 17 passes through the wall body of the pump case 41, protruding to the right as seen in the drawing of FIG. 3, to form a rightward protruding portion. A plastic oil pump gear 44 is secured to the rightward protruding portion of the oil pump shaft 17, by way of a tenon 17*a* on a leading end of the oil pump shaft 17 and a set plate 45 having a mortised opening 45*a* formed therein, as will be further described. The plastic oil pump gear 44 meshes with the shared drive gear 26 on the crankshaft 10.

The set plate 45 is fitted into a set plate mounting recess 44*a* provided on a front surface of the oil pump gear 44. The tenon 17*a*, on the leading end of the oil pump shaft 17, is fitted in a mortised opening 45*a* formed in a central portion of the set plate 45. An oil pump rotor 46 is fitted over the oil pump shaft 17, on an end of the shaft opposite the tenon.

As the crankshaft 10 rotates, the oil pump rotor 46 is rotated via the shared drive gear 26, the oil pump gear 44, the set plate 45, the tenon 17*a*, and the oil pump shaft 17.

Figure 4:
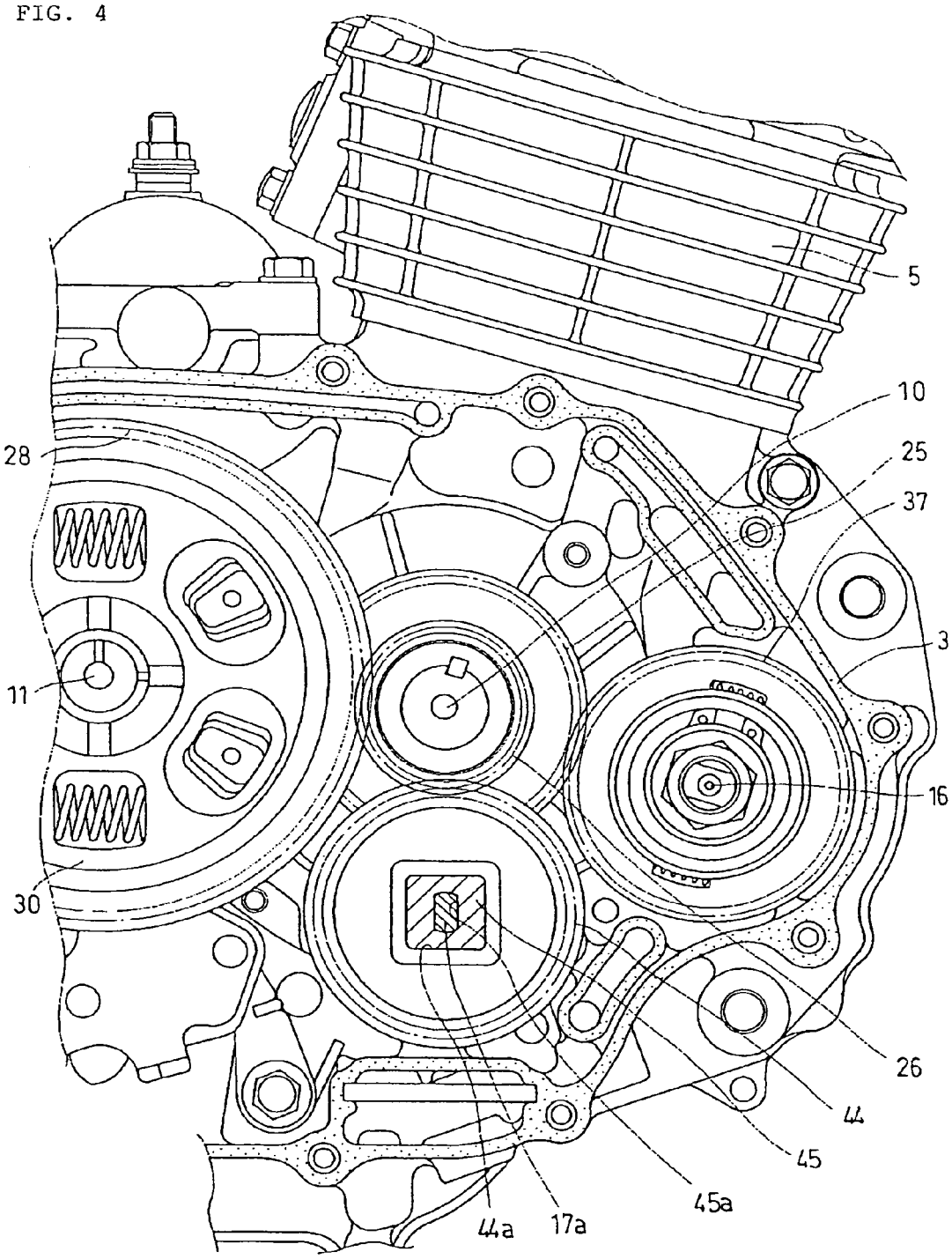
FIG. 4 is a cross sectional detail view of the engine of FIGS. 1–3, taken along line IV—IV of FIG. 3 showing the crankshaft, the main transmission shaft, the balance shaft, and the tenon on the leading end of the oil pump shaft.

FIG. 4 is a cross sectional view taken along line IV—IV of FIG. 3, showing the crankshaft 10, the main transmission shaft 11, the balance shaft 16, and the tenon 17*a* on the leading end of the oil pump shaft 17. The shared drive gear 26 on the crankshaft 10 meshes with the main shaft driven gear 28 on the main transmission shaft 11, and also meshes with the plastic oil pump gear 44 on the oil pump shaft 17. The balancer drive gear 25 on the crankshaft 10 meshes with the balancer driven gear 37 on the balance shaft 16.

Still referring to FIG. 4, the set plate 45 for inhibiting relative rotation is interposed between the plastic oil pump gear 44 and the oil pump shaft 17. The set plate 45 is a rectangular metal plate provided at the center thereof with the mortise 45*a* having two faces running in parallel with each other. Steel is a material which is usable to form the set plate 45.

In the depicted embodiment, the set plate mounting recess 44*a* is formed in a rectangular shape, in which the set plate 45 fits, is provided on the front surface at the portion of the plastic oil pump gear 44, at which the oil pump shaft 17 is connected. The set plate 45 fits into this set plate mounting recess 44*a*. A driving force from the plastic oil pump gear 44 is transmitted through four faces around the set plate mounting recess 44*a* and edge surfaces of the set plate 45, on which the four faces of the set plate mounting recess 44*a* abut.

The oil pump shaft 17 is a shaft made of steel. The tenon 17*a* is provided on the end of the oil pump shaft 17 to be connected to the oil pump gear 44. The tenon 17*a* is to be fitted into the mortise 45*a* in the set plate 45. The tenon 17*a* on the end of the shaft has a cross section of the same shape as a cross section of the mortise 45*a* in the set plate 45. Specifically, the tenon 17*a* includes two surfaces that run in parallel with, and abut on, the two parallel surfaces of the mortise 45*a* in the set plate 45. A driving force from the set plate 45 is transmitted to the oil pump shaft 17 through these parallel abutment surfaces.

The tenon 17*a* is set to have such a length that, when the plastic oil pump gear 44 is to be connected to the oil pump shaft 17, the mortise 45*a* is first aligned with the tenon 17*a*, and then is followed by the step of mounting the tenon 17*a* in the mortise 45*a*. When the mounting of the tenon 17*a* in the mortise 45*a* has proceeded a predetermined amount, the plastic oil pump gear 44 is meshed with the mating shared drive gear 26.

The connection structure between the plastic gear and the shaft according to the preferred embodiment of the present invention is arranged as described in the foregoing. The set plate 45 has the four edge surfaces therearound that are in contact with the recess 44*a* of the plastic gear 44. This allows the driving force of the gear to be transmitted to the set plate 45 through the four edge surfaces. This connection structure has a greater surface area for transferring pressure as compared with the known lock pin assembly. The inventive connection structure allows surface pressure to be reduced, thus resulting in enhanced durability of the plastic gear 44.

Assembly steps proceed as follows when assembling the oil pump 40, the oil pump shaft 17, and the plastic oil pump gear 44 using the connection structure between the plastic gear and the shaft according to the preferred embodiment of the present invention. Specifically, with the tenon 17*a* aligned with the mortise 45*a* and with the plastic oil pump gear 44 not in mesh with the shared drive gear 26, the plastic oil pump gear 44 is assembled together with the set plate 45 and the oil pump shaft 17.

Then, the plastic oil pump gear 44 is meshed with the shared drive gear 26. The tenon 17*a* is provided with length that is relatively long as described in the foregoing. This extended length allows phase matching between the oil pump gear and the oil pump shaft to be performed when the plastic oil pump gear 44 is not yet in mesh with the shared drive gear 26. This enhances efficiency in phase matching work.

According to the prior art arrangement, the lock pin used as a locking member interposed between the oil pump gear and the oil pump shaft is passed through the oil pump shaft. This makes it difficult to bring gears into mesh with each other after phase matching of the oil pump rotor has been performed.

In accordance with an embodiment of the present invention, on the other hand, the set plate 45 is used as the locking member and, unlike the prior art arrangement, the oil pump shaft 17 (the tenon 17*a* on the leading end thereof) is passed through the locking member (set plate 45). This allows the axial position of the oil pump gear to be freely changed relative to the axial position of the oil pump shaft.

This makes it possible to first perform phase matching between the oil pump gear and the oil pump shaft, and then to bring the oil pump gear into mesh with the drive gear. This enhances efficiency in pump and gear assembly work.

Although the present invention has been described herein with respect to a number of specific illustrative embodiments thereof, the foregoing description is intended to be illustrative, and not restrictive. Those skilled in the art will realize that many modifications of the embodiment could be made which would be operable. All such modifications that are within the scope of the claims are intended to be within the scope and spirit of the present invention.

Having, thus, described the invention, what is claimed is:

1. In a rotatable gear assembly comprising a shaft and a plastic gear mountable on said shaft for operatively connecting to a separate mating gear, the improvement comprising connection structure provided between the plastic gear and the shaft for allowing the shaft to rotate integrally with the plastic gear, said connection structure comprising:

a rectangular set plate having a mortised opening formed in a central portion thereof;

a rectangular recessed portion formed in a front surface of the plastic gear, said recessed portion configured to receive the set plate therein; and a tenon provided on an end of the shaft, said tenon configured and dimensioned to fit through the mortised opening of the set plate;

wherein the tenon has a length such that, during manufacture of the assembly when the plastic gear is mounted on the shaft, the tenon is aligned with and inserted into the mortise, and when the tenon has been inserted in the mortise a predetermined distance, the plastic gear becomes enmeshed with the mating gear.

2. A connection structure comprising a driven gear, a set plate, and a shaft, wherein the driven gear comprises a gear body having a first face, and a second face opposed to the first face, wherein the first face has a recess formed therein, said recess sized and shaped to receive the set plate in a nested, fitted manner therein, the shaft comprising an elongate member, the member having a first end and a second end, the first end having a shaft tenon formed thereon, the shaft tenon extending from the first end so as to be substantially co-axial with the elongate member, the set plate comprising a plate body with a mortised opening formed in a central portion thereof, the set plate mortise having a cross-sectional shape corresponding to the shaft tenon, wherein the set plate fits within the recess of the gear, and wherein the shaft tenon is received within the mortised opening of the set plate.

3. The connection structure of claim 2 wherein the shaft tenon is provided in a length that allows the mortise to reside in more that one position along the shaft tenon.

4. The connection structure of claim 2 wherein the shaft tenon has a predetermined length, and the gear body is provided has a measurable thickness, and wherein the length of the shaft tenon is at least twice the thickness of the gear body.

5. The connection structure of claim 2 wherein the connection structure further comprises a mating gear, and wherein the mating gear is sized and shaped to interact with the driven gear;

wherein the shaft tenon is provided having a length such that the shaft tenon can be mounted within the set plate mortise while the gear is not positioned to interact with the mating gear, and also upon adjustment longitudinally along the shaft tenon, the shaft tenon can be mounted within the set plate mortise while the gear is positioned to interact with the mating gear.

6. The connection structure of claim 5, wherein the gear recess and the set plate are each respectively provided with a rectangular shape.

7. The connection structure of claim 5 wherein the shaft tenon has a cross-sectional shape that provides at least one pair of parallel sides.

8. The connection structure of claim 7 wherein the shaft tenon is sized to fit engagingly within the mortised opening of the set plate, so that the driven gear is non-rotably disposed relative to the shaft, and is capable of concurrent movement therewith.

9. The connection structure of claim 2 wherein the connection structure further comprises a mating gear and a rotor, wherein the mating gear is sized and shaped to interact with the driven gear;

wherein the rotor is mounted adjacent to the second end of the shaft such that the rotor is driven by the shaft, and wherein the shaft tenon is provided having a length such that the set plate mortise can be mounted at a first position along the shaft tenon such that the driven gear is not positioned to interact with the mating gear allowing phase matching of the rotor with the shaft, and the set plate mortise can be mounted at a second position along the shaft tenon such that the driven gear is positioned to interact with the mating gear.

10. The connection structure of claim 9 wherein the shaft is formed of steel and the gear is formed of plastic.

11. An oil pump for an internal combustion engine, comprising:

a metal shaft having a first end with an integral mating extension formed thereon and a second end opposite said first end, wherein said mating extension has a non-circular cross-sectional shape;

a driven gear which slidably fits on said first end of said shaft, said gear driven gear comprising a plastic material and having an opening formed centrally therein which receives said shaft therethrough, said driven gear having a recess formed therein surrounding said opening and having a non-circular outline shape; and a metal set plate having a non-circular outline shape configured to fit into said recess of said driven gear, said set plate having a substantially central opening formed therein and having a shape configured to receive the mating extension of said shaft such that said driven gear is non-rotatably disposed relative to said shaft, and is capable of concurrent movement therewith.

12. The oil pump of claim 11, further comprising a rotor which is affixed to said second end of said shaft.

13. The oil pump of claim 11, wherein said driven gear is slidably disposed on said shaft.

14. The oil pump of claim 11, wherein the mating extension is provided in a length that allows the set plate to reside in more that one position along the shaft.

15. The oil pump of claim 11, wherein the mating extension has a predetermined length, and the driven gear has a measurable thickness, and wherein the length of the mating extension is at least twice the thickness of the driven gear.

16. The oil pump of claim 11, wherein the gear recess and the set plate are each respectively provided with a rectangular shape.

17. The oil pump of claim 11, wherein the mating extension has a cross-sectional shape that provides at least one pair of parallel sides.

18. The oil pump of claim 11, wherein the mating extension is sized to fit nestingly within the central opening of the set plate.

19. An internal combustion engine, comprising the oil pump of claim 11.

* * * * *